United States Patent [19]

Edwards

[11] 3,974,659

[45] Aug. 17, 1976

[54] OIL SAMPLING AND CHARGING METHOD AND APPARATUS FOR REFRIGERATION SYSTEMS

[76] Inventor: Murel C. Edwards, 4208 Shore Drive, Lorain, Ohio 44052

[22] Filed: Apr. 16, 1975

[21] Appl. No.: 568,715

[52] U.S. Cl. ..... 62/84; 62/85; 62/471

[51] Int. Cl.[2] ..... F25B 43/02; F25B 47/00

[58] Field of Search ..... 62/84, 85, 470, 471, 62/473, 149

[56] References Cited

UNITED STATES PATENTS

| | | | |
|---|---|---|---|
| 2,364,783 | 12/1944 | Goddard et al. | 62/471 |
| 2,749,723 | 6/1956 | Webber | 62/470 |
| 2,749,723 | 6/1956 | Webber | 62/470 |
| 2,786,340 | 3/1957 | Chausson | 62/84 |
| 3,021,689 | 2/1962 | Miller | 62/84 |
| 3,283,532 | 11/1966 | Kocher | 62/84 |
| 3,461,682 | 8/1969 | Darby | 62/85 |

*Primary Examiner*—Lloyd L. King
*Attorney, Agent, or Firm*—Fay & Sharpe

[57] ABSTRACT

The specification and drawings disclose a method and apparatus for taking a sample of oil from the refrigerant fluid circulating in a refrigeration unit of the type including a compressor, a condenser, and an evaporator. A pressure chamber is provided which may be conveniently connected to cause the hot vapor gas coming from either the compressor or condenser and pass through the chamber. As the hot vapor gas enters the chamber it is impinged against a baffle causing the oil within the vapor gas to collect as droplets and flow to the bottom of the chamber. The oil free refrigerant vapor gas is thereafter extracted from the chamber and returned to the refrigeration unit at a point on the low pressure side of either the compressor or condenser. The extraction from the chamber takes place at a point below the level at which the vapor gas is supplied to the chamber and at the opposite side of the baffle. The collected oil level within the chamber is regulated by the level of extraction. When sufficient oil is recovered for test purposes the chamber is disconnected from the refrigeration unit and oil removed from the chamber. The same general method and apparatus can be used for charging predetermined quantities of oil into a refrigeration system.

10 Claims, 4 Drawing Figures

OIL SAMPLING AND CHARGING METHOD AND APPARATUS FOR REFRIGERATION SYSTEMS

BACKGROUND OF THE INVENTION

The subject invention is directed toward the art of refrigeration and, more particularly, to a method and an apparatus for taking oil samples and charging refrigeration systems.

The invention will be described with reference to its use on a conventional freon refrigeration system which includes means or provisions for removing and/or adding oil thereto; however, as will become apparent, the invention has broader applications any may be advantageously employed on many other types and styles of refrigeration systems.

In the typical evaporative-type refrigeration unit it is sometimes necessary or desirable to remove an oil sample from the closed refrigeration cycle. Preferably, the sample should be taken while the unit is in operating condition over a period of time. The sample allows the service technician to test for contaminants circulating within the system. Typical contaminants could include acid, moisture, and the like.

With the information obtained from the sample, the technician is able to perform preventative maintenance to eliminate future problems resulting from the contaminants.

The subject method and apparatus permits samples to be taken rapidly and efficiently while the refrigeration system is operating. In addition, variations on the basic method and apparatus can be used to charge a fixed amount of oil into the refrigeration cycle. The method and apparatus permit the charging to be accomplished without loss of the refrigerant charge or opening of the cycle in a manner to expose it to air and/or moisture.

BRIEF DESCRIPTION OF THE INVENTION

The method of the invention generally comprises a sequence of steps by which hot oil laden refrigerant gas vapor or fluid is by-passed around either the compressor or condenser and passed through a closed pressure chamber. As used hereinafter, the term fluid is deemed to include any and all such gas vapors as well as other types and forms of fluids which might be employed in other systems to which the concepts of the subject invention are deemed equally applicable. The hot fluid supplied from the high pressure side of the condenser is supplied to the pressure chamber and impinged or sprayed against an interior baffle. This causes the oil in the hot fluid to collect as droplets and flow to the bottom of the chamber. The refrigerant fluid is extracted from the chamber and returned to the refrigeration unit on the low pressure side of either the compressor or condenser. Extraction preferably takes place below the point at which the hot fluid is supplied to the chamber and on the opposite side of the baffle. The level at which extraction takes place regulates the quantity of oil collected. The reason for this is that as soon as the oil level reaches the level of extraction, the excess oil is returned to the refrigeration unit.

The preferred apparatus for carrying out the method comprises a portable container forming a closed pressure chamber. A baffle member is mounted in the chamber and extends from the top to a position spaced from the bottom. A first fluid line provides communication from the exterior to the interior of the chamber.

The interior end of the first fluid line is directed toward the baffle and a first valve is provided to control flow therethrough. A second fluid line extends from the interior of the chamber at a point below the first line and opposite the baffle to the exterior of the chamber. A second valve controls flow through the second line.

In use, the first line is connected to the high pressure side of either the compressor or condenser and the second line connects to the low pressure side. As the hot refrigerant flows through the chamber, it impinges against the baffle and the oil collects as droplets on the baffle and the walls of the container. The total amount of oil collected depends upon the distance of the inlet to the second line above the bottom of the chamber.

In addition to the above, the apparatus includes a valved third line connected to the bottom of the container. This allows the oil collected in the chamber to be drained and also permits the apparatus to be used to charge oil into a refrigeration unit. The apparatus also preferably includes a gauge glass and pressure gauge to permit the operator to monitor conditions within the chamber.

OBJECTS OF THE INVENTION

Accordingly, a primary object of the invention is the provision of a method and apparatus which permits oil samples to be taken from an operating refrigeration unit simply and safely.

Another object is the provision of an apparatus of the type described which can also be used for charging oil into refrigeration systems.

A further object is the provision of a sampling apparatus which is readily portable and can be used for performing periodic maintenance tests on many different refrigeration units.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENTS

Figure 1:
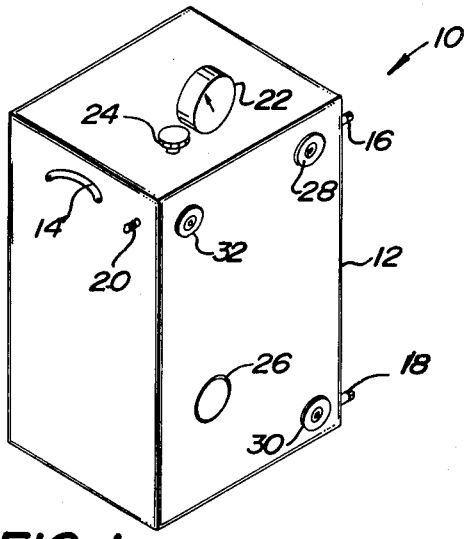
FIG. 1 is a pictorial view of a typical sampling apparatus formed in accordance with the subject invention.
Figure 2:
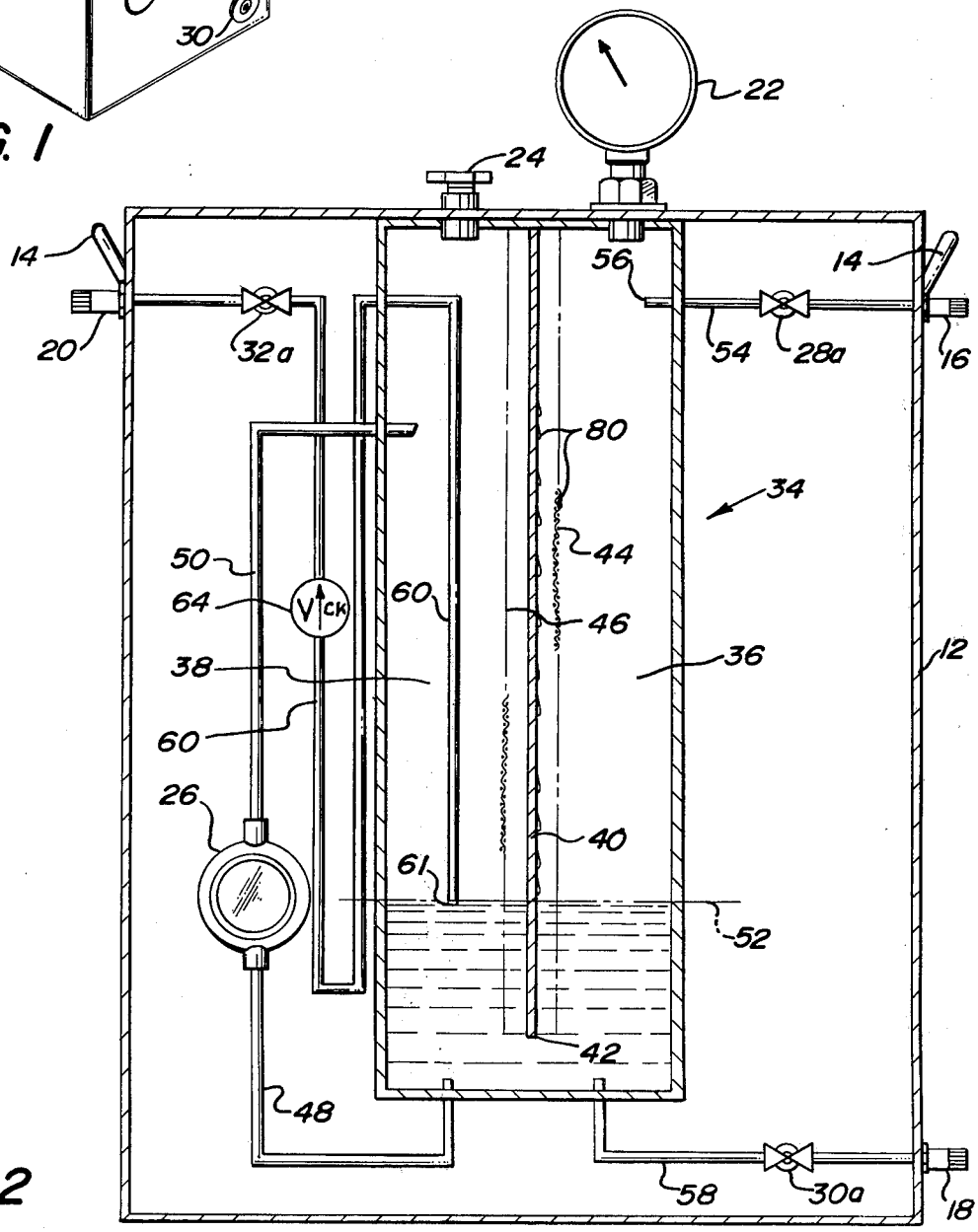
FIG. 2 is a cross-sectional view taken on line 2—2 of FIG. 1 and showing the internal details of construction of the apparatus.

Referring more particularly to the drawings wherein the showings are for the purposes of illustrating the preferred embodiments of the invention only and not for the purpose of limiting same, FIGS. 2 and 1 show the general overall arrangement and construction of a sampling and charging apparatus 10 formed in accordance with an aspect of the invention. The apparatus 10 could have a variety of constructions but is illustrated as comprising a relatively light-weight, sheet-metal housing 12 provided with suitable handles 14 to permit the apparatus to be easily transported and manipulated. Visible from the exterior of the apparatus (FIG. 1) are quick release hose or tubing connectors 16, 18, 20, a pressure gauge 22, an access fitting 24, a gauge glass 26, and valve actuating handles 28, 30, and 32. The function of these elements and their relationship to the overall apparatus and its use will become apparent from the following description.

Referring more particularly to FIG. 2, the apparatus 10 is shown as including a pressure chamber or container 34 suitably mounted within the housing 12. Container 34 is constructed from material capable of withstanding the pressures and environment to which it is subjected. The interior of container 34 is divided into two chambers 36 and 38 by a baffle plate 40 which extends downwardly from the tip of the container 34. As shown, the lower edge 42 of plate 40 terminates a short distance above the bottom of container 34. The ends of the baffle are spaced from the side walls to provide fluid communication between the chambers 36 and 38. It should be appreciated that other arrangements could be provided for assuring the required communication.

Positioned a short distance outwardly from opposite sides of baffle plate 40 are comparatively fine mesh screens 44 and 46. The previously mentioned pressure gauge 22 is connected with the upper end of the pressure container 34 and gives a continuous reading of the pressure therein. Similarly, the access fitting 24 permits access to the interior of the container and is required for certain operations to be described.

The level of liquid within the chamber is continuously shown by the gauge glass 26 which is connected at its lower end to the bottom of container 34 at its lower end by a line 48. A second line 50 connects the upper end of gauge glass 26 with the interior of the container 34 at a level substantially above the normal maximum liquid level 52.

The chambers 36 and 38 are capable of being placed in fluid communication with the exterior of the housing 12 by a first line 54 which extends between quick connect fitting 16 and the upper end of chamber 36 well above the normal maximum liquid level 52. It is important to note that the inner end 56 of line 54 points toward screen 44 and baffle plate 40. Flow through line 54 is controlled by valve 28*a* which is operable from the exterior of the housing 12 by the manual valve operator 28.

The lower end of container 34 is communicated with quick connect fitting 18 by a line 58 which communicates with the inside of chamber 36 below liquid level 52. Valve 30*a* functions to control flow through line 58 and is operable from the exterior of housing 12 by manual valve operator 30.

A third flow line 60 connects from quick connect fitting 20 to the interior of chamber 38. As shown, the inner end 61 of line 60 terminates at approximately the liquid level 52. A spring loaded check valve 64 is mounted in line 60 and prevents reverse flow from fitting 20 to chamber 38. Additionally, manual control of flow through the line 60 is possible with valve 32a and its manual operator 32.

METHOD OF USE FOR SAMPLE TAKING

Figure 3:
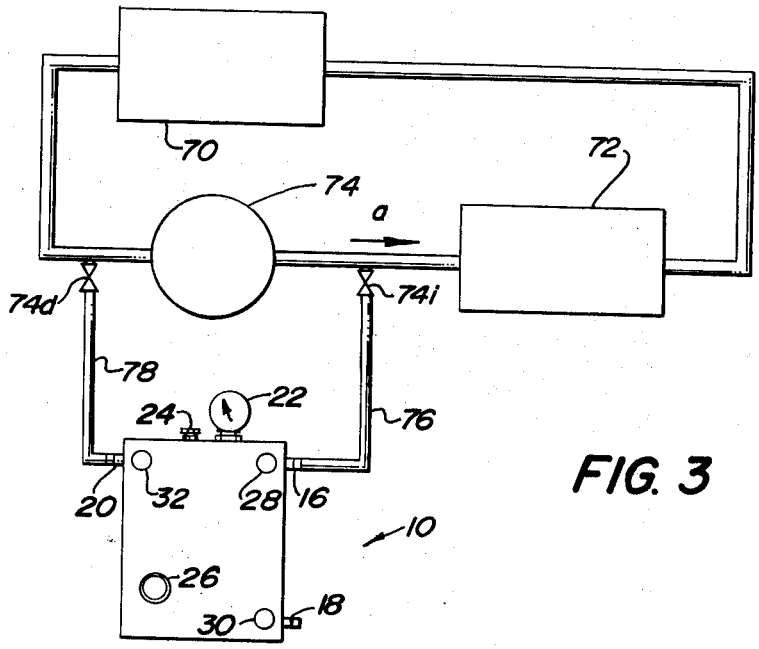
FIG. 3 is a somewhat diagrammatic view showing the apparatus in use for taking a sample from a refrigeration system; and, FIG. 4 is a diagrammatic view similar to FIG. 2, but showing the apparatus being used for charging oil into the refrigeration system.

The apparatus thus far described can be easily used for taking an oil sample from the refrigerant circulating within a conventional refrigeration system. FIG. 3 shows, in diagrammatic form, the use of the apparatus 10 to take an oil sample from a refrigeration unit comprising an evaporator 70, a condenser 72 and a compressor 74. The flow of refrigerant fluid through the unit is in the direction of arrow *a*.

Broadly, the apparatus 10 is connected between the high and low pressure sides of the refrigeration unit by suitable flexible pressure hose or the like. The connections are made to test valves supplied with the refrigeration unit by the manufacturer, or to test valves installed by the service technician. The use and installation of such valves is well known to refrigeration service personnel.

Specifically, to obtain an oil sample the apparatus 10 is placed in an upright position and valves 28*a*, 30*a* and 32*a* are closed. Additionally, fitting 24 must be tightly closed. In the arrangement shown in FIG. 3, a line 76 is then connected between the high pressure side of the compressor 74 and fitting 16. A second line 78 is connected between fitting 20 and the low pressure side of the compressor 74. However, it should be appreciated that the concepts of the subject invention may also be practiced by connecting apparatus 10 to the high and low pressure sides of condenser 72 in the same manner and fashion as described herein with regard to compressor 74. Other areas of the refrigeration unit could also be employed, it merely being necessary to have a pressure differential between the point at which fluid is conducted from the unit and the point at which fluid is conducted back to the unit. Normally, however, and because of the results obtained, apparatus 10 is connected across the compressor when the sampling time will be of a short duration and across the condenser when the sampling time will be of a larger duration as, for example, several hours or overnight.

In making the noted connections the lines 76 and 78 should be purged of air. Such purging is standard technique for service personnel. Additionally, the apparatus 10 must be purged. To do this, the valve 74*i* is opened as well as valve 28*a*. This permits flow through line 76. Gauge 22 is viewed until operating pressure is reached. Thereafter, valve 28*a* is closed and the connection of line 78 to valve 74*d* is loosened. Valve 32*a* is then opened and the unit purged until the pressure therein is approximately zero.

Subsequently, the connection of line 78 to valve 74*d* is tightened and then valve 28*a* is opened. Of course, valves 74*d* and 74*i* must also be opened. This causes oil laden hot or discharged compressed refrigerant vapor gas or fluid coming from the compressor to pass through the apparatus 10. As the oil laden gas enters chamber 36 through line 54, it is directed or sprayed against screen 44 and baffle plate 40. Small drops 80 of the oil accumulate on the screen 44, baffle plate 40 and, also, on the walls of chamber 36. The drops of oil flow downwardly and gather at the bottom of the container. The substantially oil free hot gas passes about the baffle plate 40 and enters line 60 through opening 61. Hot gas returns to the refrigeration unit through check valve and valve 32*a* to the low pressure side of the compressor 74. This continues until the level of oil in the container reaches the lower end 61 of line 60.

As can be appreciated, the quantity of oil accumulated in the container is controlled by the level of opening 61. As soon as the oil reaches this level it is forced out of the apparatus through line 60 to the low pressure side of the compressor. Consequently, the location of opening 61 should be selected such that only enough oil is extracted to perform the required tests. This prevents too much oil from being removed so that damage to the refrigeration unit from insufficient oil will not result. The gauge glass lets the technician know when the required oil level has been reached.

Upon reaching the required oil level, valves 28*a* and 32*a* are closed, followed by the closing of valves 74*d* and 74*i*. Lines 76 and 78 are disconnected from apparatus 10. Preferably, the pressure within container 34 is reduced by slowly opening valve 28*a* after the apparatus has been disconnected. Generally, some low pressure will be permitted to remain in the container to facilitate oil removal.

To remove the oil from the apparatus valves 32*a* and 28*a* remain closed and valve 30*a* is opened. The small pressure remaining in the container causes the oil to discharge through line 58 to a suitable test receptacle. Of course, it is also possible to drain the oil merely by opening valve 28*a* and permitting it to flow out of line 58 by gravity.

To clean the apparatus, a solvent or the like is introduced to chamber 34 through fitting 24. Thereafter, the solvent can be drained out through line 58. It should be appreciated that valves 28*a* and 32*a* should be opened and valve 30*a* closed when the cleaning solution is introduced.

TO USE THE APPARATUS FOR OIL CHARGING

Figure 4:
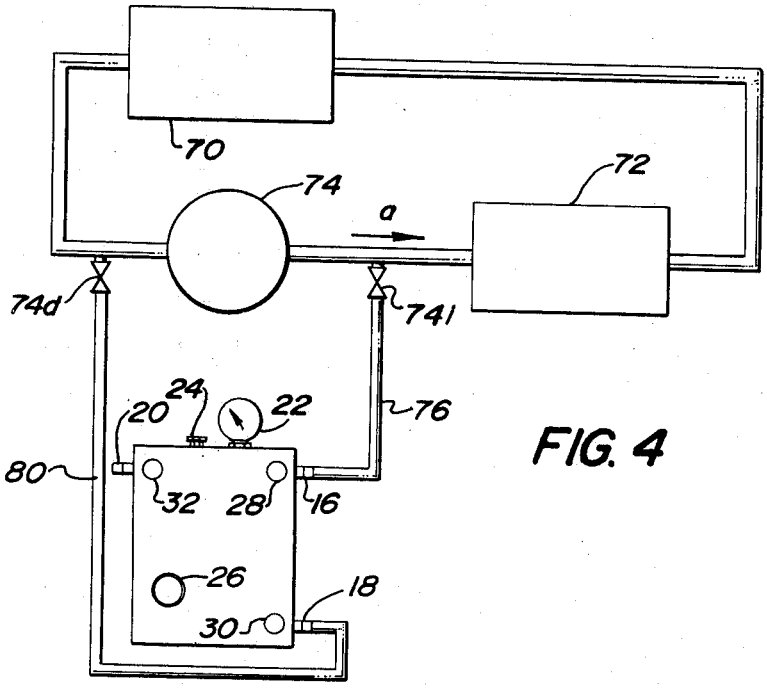

In addition to using the apparatus 10 for oil sampling it is also possible to use it for introducing oil or other fluid into a refrigeration system. FIG. 4 illustrates the apparatus in use for oil charging across the compressor 74. As shown, the apparatus is placed in an upright position. Oil is introduced to chamber 34 through fitting 24. Valves 28*a* and 32*a* are open at this time. Valve 30*a* is closed.

When sufficient oil is in chamber 34, the fitting 24 and valves 28*a* and 32*a* are closed. Thereafter, a suitable line 76 is connected from valve 74*i* to fitting 16. A second line 80 is connected from fitting 18 to valve 74*d*. (The lines should be purged of air as discussed above.) After the lines 76 and 80 have been connected, valves 74*i* and 28*a* are opened, followed by valves 74*d* and 30*a*. The oil is thus forced from the apparatus into the refrigeration unit. Flow of the oil can be regulated by valve 30*a*.

It should be understood that the process can be repeated as often as required to inject any amount of oil required. Again, both sampling and charging may be effected across the high and low pressure sides of either compressor 74 or condenser 72 as well as other areas where there is a pressure differential within the system or unit. However, in the preferred arrangement, such sampling and charging is effected across the compressor. Further, and as used herein, the term fluid is deemed to include any and all gas vapor as well as other types and forms of fluids which might be employed in other systems to which the concepts of the subject invention are deemed equally applicable.

As can be appreciated from the foregoing, the subject method and apparauts allows refrigeration unit oil sampling and charging to be carried out simply and easily. Obviously, modifications and alterations of the preferred embodiments will occur to others upon a reading and understanding of the specification. It is my intention to include all such modifications and alterations as part of my invention insofar as they come within the scope of the appended claims.

Having thus described my invention, I now claim:

1. Portable apparatus for taking an oil sample from the refrigerant flowing in a closed cycle refrigeration system comprising:

a portable container forming a closed pressure chamber;

a baffle member positioned within said chamber;

a first fluid line providing communication from the exterior to the interior of said chamber, said first fluid line including a first valve for controlling the flow of fluid therethrough and a first discharge opening adjacent to the upper end of said chamber and directed toward said baffle;

a second fluid line providing communication between the exterior and interior of said chamber, said second line including a check valve for preventing flow through said second line into said chamber while permitting flow out of said chamber, and a second valve in said second line for selectively preventing flow in either direction, said second line opening to the interior of said chamber substantially below said first line a predetermined distance above the bottom of said chamber on the side of said baffle opposite said first fluid line;

gauge means for providing an indication of the pressure within said chamber;

gauge glass means for providing an indication of the liquid level within said chamber; and, a third fluid line opening to the bottom of said chamber below said first and second lines, said third line including a third valve means for controlling flow of fluid therethrough.

2. The apparatus as defined in claim 1 including an access opening at the upper end of said chamber whereby fluid can be selectively placed in said chamber.

3. The apparatus as defined in claim 1 including a screen extending transversely between said baffle and said first discharge opening.

4. The apparatus as defined in claim 1 including a housing enclosing said pressure container, said first, second and third lines extending out of said housing and terminating in fittings for connecting said apparatus to a refrigeration unit.

5. The apparatus as defined in claim 4 wherein said valve means are manually operable from the exterior of said housing.

6. A method of taking an oil sample from the refrigerant flowing in a refrigeration unit of the type including a compressor, a condenser, and an evaporator, comprising the steps of:

providing a closed chamber capable of withstanding the discharge pressure from said compressor, said chamber having a baffle member therein;

conducting oil laden refrigerant fluid from said unit and supplying it to the upper end of said chamber and impinging it against said baffle to cause the oil to separate from said refrigerant fluid;

collecting said oil in the bottom of said chamber;

extracting the refrigerant fluid from said chamber at a point below the point at which it is impinged against said baffle and on the opposite side of said baffle, and conducting the refrigerant fluid to said refrigeration unit and introducing it back into said unit at a point therein where there is a pressure differential with the point at which said refrigerant fluid was conducted from said unit to said chamber; and, continuing the above steps until the quantity of oil within said chamber reached a predetermined level.

7. The method as defined in claim 6 wherein the step of conducting oil laden refrigerant to said chamber is continued until the level of oil in said chamber reaches the level of the point at which the refrigerant fluid is extracted from said chamber.

8. The method as defined in claim 6 wherein the step of conducting oil laden refrigerant from said unit comprises the step of conducting from a high pressure side of said unit and the step of conducting said refrigerant fluid to said unit comprises the step of conducting to a low pressure side of said unit.

9. The method as defined in claim 8 wherein the step of conducting oil laden refrigerant fluid from said unit comprises the step of conducting said refrigerant fluid from a point between said compressor and condenser and said step of conducting said refrigerant fluid to said unit comprises the step of conducting said refrigerant fluid to a point between said evaporator and compressor.

10. The method as defined in claim 8 wherein the step of conducting oil laden refrigerant fluid from said unit comprises the step of conducting said refrigerant fluid from a point between said condenser and evaporator and said step of conducting said refrigerant fluid to said unit comprises the step of conducting said refrigerant fluid to a point between said compressor and condenser.

* * * * *